US011368798B2

(12) United States Patent
Kuebert et al.

(10) Patent No.: US 11,368,798 B2
(45) Date of Patent: Jun. 21, 2022

(54) METHOD FOR THE ENVIRONMENT-DEPENDENT OPERATION OF A HEARING SYSTEM AND HEARING SYSTEM

(71) Applicant: Sivantos Pte. Ltd., Singapore (SG)

(72) Inventors: Thomas Kuebert, Lohr (DE); Stefan Aschoff, Eckental (DE)

(73) Assignee: Sivantos Pte. Ltd., Singapore (SG)

( * ) Notice: Subject to any disclaimer, the term of this patent is extended or adjusted under 35 U.S.C. 154(b) by 9 days.

(21) Appl. No.: 17/113,622

(22) Filed: Dec. 7, 2020

(65) Prior Publication Data

US 2021/0176572 A1 Jun. 10, 2021

(30) Foreign Application Priority Data

Dec. 6, 2019 (DE) ..... 102019219113
Jul. 13, 2020 (DE) ..... 102020208720

(51) Int. Cl.
*H04R 25/00* (2006.01)

(52) U.S. Cl.
CPC ..... *H04R 25/505* (2013.01); *H04R 25/55* (2013.01); *H04R 25/70* (2013.01)

(58) Field of Classification Search
CPC ..... H04R 25/505; H04R 25/55; H04R 25/70; H04R 2225/41; H04R 1/1083
See application file for complete search history.

(56) References Cited

U.S. PATENT DOCUMENTS 9,813,833 B1 * 11/2017 Vesa ..... H04R 29/006
2010/0027820 A1 * 2/2010 Kates ..... H04R 25/505 381/312

(Continued)

FOREIGN PATENT DOCUMENTS

JP 2005203981 A 7/2005

OTHER PUBLICATIONS

Gisbrect, Andrej, et al. in "Out-of-Sample Kernel and Extensions for Nonparametric Dimensionality Reduction", ESANN 2012 proceedings, European Symposium on Artificial Neural Networks, Computational Intelligence and Machine Learning, Bruges (Belgium), Apr. 25-27, 2012.

(Continued)

*Primary Examiner* — Tuan D Nguyen
(74) *Attorney, Agent, or Firm* — Laurence A. Greenberg; Werner H. Stemer; Ralph E. Locher

(57) ABSTRACT

In a method for the environment-dependent operation of a hearing system values for a first plurality of environmental data of a first user of the hearing system are determined each time in a training phase for survey times, and the values of the environmental data for each of the survey times are used to form respectively a feature vector in an at least four-dimensional feature space. Each of the feature vectors is mapped respectively onto a corresponding representative vector in a maximum three-dimensional representation space, and a spatial distribution of a subgroup of representative vectors is used to define a first region in the representation space for a first environmental situation of the hearing system. A value of a setting for signal processing of the hearing system is specified for the first environmental situation, and the hearing system is operated with the value set in this way.

20 Claims, 1 Drawing Sheet

(56) References Cited

U.S. PATENT DOCUMENTS

| | | | | |
|---|---|---|---|---|
| 2011/0058698 | A1* | 3/2011 | Buhmann | H04R 25/70 381/314 |
| 2014/0294212 | A1* | 10/2014 | Barthel | H04R 25/505 381/314 |
| 2014/0355798 | A1 | 12/2014 | Sabin | |
| 2015/0124984 | A1 | 5/2015 | Han et al. | |
| 2021/0168521 | A1* | 6/2021 | Goorevich | H04R 25/505 |
| 2021/0368263 | A1* | 11/2021 | Vesa | H04R 3/04 |

OTHER PUBLICATIONS

Gisbrect, Andrej, et al. "Parametric nonlinear dimensionality reduction using kernel t-SNE", Neurocomputing, vol. 147, 71-82, Jan. 2015.

* cited by examiner

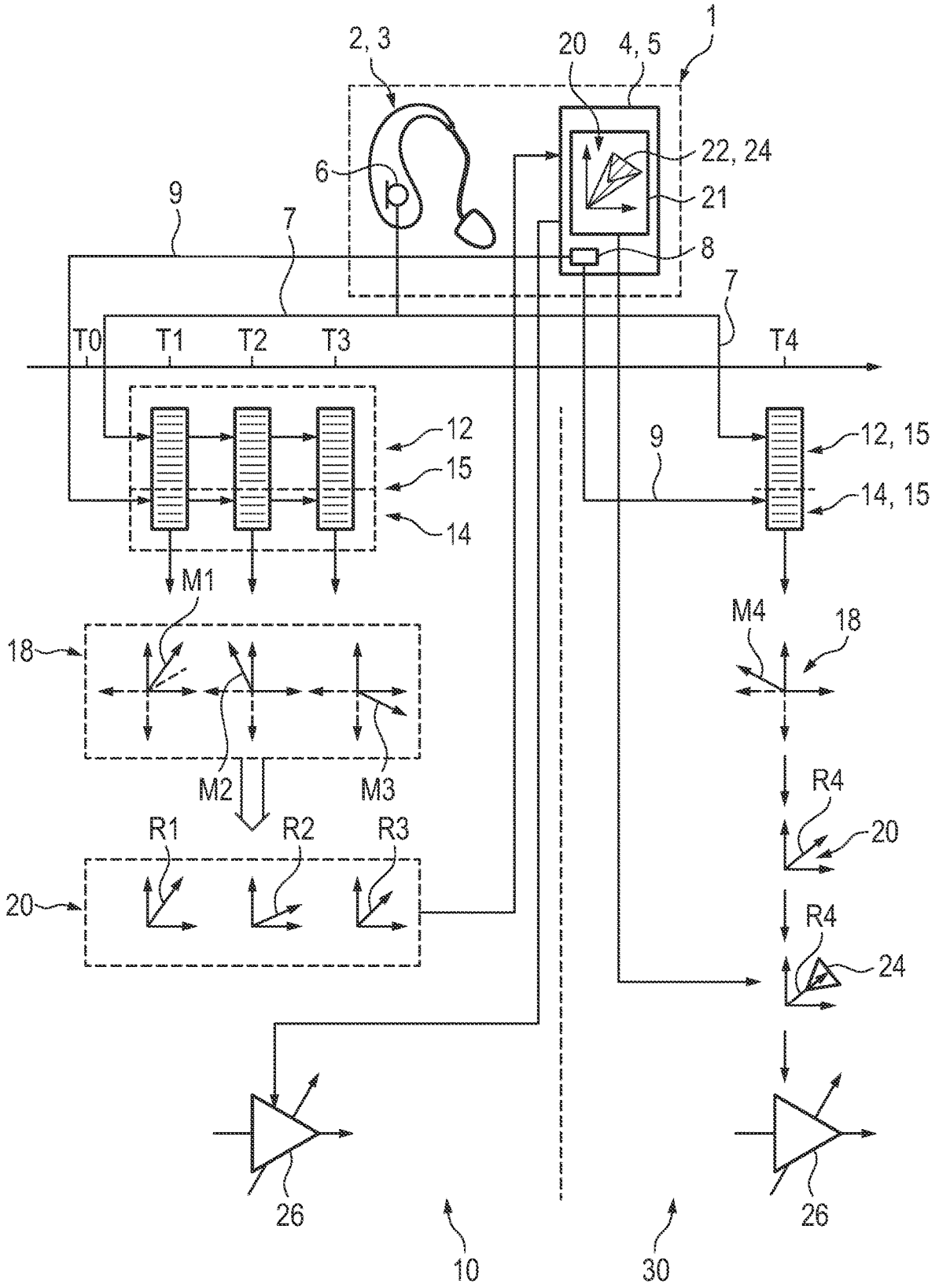
1
2, 3
20
4, 5
22, 24
21
6
9
7
8
7
T0
T1
T2
T3
T4
12
15
14
9
12, 15
14, 15
M1
18
M4
18
M2
M3
R4
20
R1
R2
R3
20
R4
24
26
26
10
30

METHOD FOR THE ENVIRONMENT-DEPENDENT OPERATION OF A HEARING SYSTEM AND HEARING SYSTEM

CROSS-REFERENCE TO RELATED APPLICATION

This application claims the priority, under 35 U.S.C. § 119, of German Patent Applications DE 10 2019 219 113, filed Dec. 6, 2019 and DE 10 2020 208 720, filed Jul. 13, 2020; the prior applications are herewith incorporated by reference in their entirety.

BACKGROUND OF THE INVENTION

Field of the Invention

The invention relates to a method for the environment-dependent operation of a hearing system. Wherein values for a first plurality of environmental data of a first user of the hearing system are determined each time in a training phase for a plurality of survey times, and the values of the environmental data for each of the survey times are used to form respectively a feature vector in a feature space. At least one value of a setting for a signal processing of the hearing system is specified for the first environmental situation, and wherein values for the first plurality of environmental data of the first user or of a second user of the hearing system are determined in an application phase at an application time and the values of the environmental data are used to form a corresponding feature vector for the application time. The at least one value of the signal processing of the hearing system is set according to its specification for the first environmental situation, and the hearing system is operated with the at least one value set in this way.

In hearing systems, a user is provided with a sound signal for hearing, which is generated on the basis of an electrical audio signal, which, in turn, represents an acoustic environment of the user. One important case of a hearing system is a hearing aid, by means of which a hearing impairment of the user should be corrected as much as possible by a signal processing of the audio signal, especially one dependent on the frequency band, so that useful signals are preferably made more audible to the user in an environmental sound. Hearing aids may be in different designs, such as BTE, ITE, CIC, RIC or others. One similar form of hearing system is a hearing assist device, such as a cochlear implant or a bone conductor. Other hearing systems may also be personal sound amplification devices (PSADs), which are used by those with normal hearing as well as headsets or headphones, especially those with active noise canceling.

An operation of a hearing system in dependence on the environment is known especially for hearing aids. In this case, the signal processing of the audio signal is established in dependence on a listening situation, the listening situations being given by standardized groups of acoustic environments with particular comparable acoustic features. If it is identified with the aid of the audio signal that one of the standardized groups is present, the audio signal will be processed with the corresponding settings previously established for this group of acoustic environments.

The definition of the listening situations is often done in advance, for example at the factory, by firm criteria given for individual acoustically measurable features. There are often presettings of the respective signal processing for the given listening situations, which can be further individualized by the user.

However, the acoustic identification of the individual listening situations is on the one hand a complex and possibly error-prone matter, since an acoustic environment might not have exactly the acoustic features which the corresponding listening situation would actually require (such as a cocktail party outdoors near a road, and so on). On the other hand, because of the many features which are evaluated in order to distinguish individual acoustic environments from each other and for a corresponding matching up of the listening situations, it is hardly possible for a user himself to produce meaningful definitions of listening situations that are ideally attuned to his daily life. Consequently, the user in this regard usually relies on the specified definitions of listening situations.

BRIEF SUMMARY OF THE INVENTION

Therefore, it is the object of the invention to indicate a method by means of which a user can on the one hand better operate a hearing system, dependent on the environment, yet the environments can be individualized as much as possible to the user.

The stated object is solved according to the invention by a method for the environment-dependent operation of a hearing system. Values for a first plurality of environmental data of a first user of the hearing system are determined each time in a training phase for a plurality of survey times, and the values of the environmental data for each of the survey times are used to form respectively a feature vector in an at least four-dimensional, especially an at least six-dimensional feature space, each of the feature vectors is mapped respectively onto a corresponding representative vector in a maximum three-dimensional, especially a two-dimensional representation space, and a spatial distribution of a subgroup of representative vectors is used to define a first region in the representation space for a first environmental situation of the hearing system. Wherein at least one value of a setting for a signal processing of the hearing system is specified for the first environmental situation.

It is provided that, values for the first plurality of environmental data of the first user or of a second user of the hearing system are determined in an application phase at an application time and the values of the environmental data are used to form a corresponding feature vector for the application time. The first region of the representation space and the feature vector for the application time are used to identify the presence of the first environmental situation, especially in automatic manner, and the at least one value of the signal processing of the hearing system is set according to its specification for the first environmental situation, especially in automatic manner, and the hearing system is operated with the at least one value set in this way. Advantageous embodiments, sometimes inventive in their own right, are the subject matter of the dependent claims and the following description.

In the training phase, thus, the first environmental situation is established on the one hand with the aid of the environmental data, and it is determined how the first environmental situation can be distinguished through the environmental data from other environmental situations. Furthermore, a setting of the signal processing is specified, which is to be applied for the first environmental situation to an audio signal of the hearing system. In the application phase, the current values present for the corresponding environmental data are determined, and it can now be determined with the aid of these values of the environmental data whether the first environmental situation is present. If so, the hearing system is operated with the given setting of the signal processing for this.

In the training phase, the values of the environmental data are determined at different survey times, so that the feature vectors which are formed with the aid of the values of environmental data determined at the individual survey times are representative of as many acoustic environments as possible. The environmental data here preferably involve acoustic environmental data for acoustic environmental quantities, such as frequencies of background noise, stationarity of a sound signal, sound level, modulation frequencies, and the like. Furthermore, environmental data may also involve "non-acoustic" data in the broad sense, such as accelerations or other motion quantities of a motion sensor of the hearing system, but also biometric data, which can be detected e.g. with the aid of EEG, EMG, PPG (photoplethysmogram), EKG or the like.

The mentioned quantities can be measured by a hearing device of the hearing system, i.e., by a hearing aid, and/or by another device of the hearing system, such as a smartphone or a smartwatch or some other suitable device with corresponding sensors. The determination of the values of the environmental data from the measured quantities can occur in the particular device itself—i.e., in the hearing aid or in the smartphone, or the like—or after a transmission, e.g., from the hearing aid or from a headset to the smartphone or a comparable device of the hearing system. The measuring of the quantities occurs preferably in continuous or quasi-continuous manner (i.e., at very short time intervals, such as in the range of seconds), preferably over a rather lengthy time of, for example, a week or the like, so that the environments usually occurring for the user are detected as completely as possible and "mapped", so to speak.

As the values of the environmental data, the values determined for the mentioned or other corresponding quantities may either enter directly into the respective feature vectors or the values entering into the feature vectors are formed by forming the mean value and/or mean crossing rate and/or variance or comparable statistical methods using the respective quantities. In the latter case, a feature sector exists, preferably formed from individual entries, which are respectively obtained in the described manner by means of statistical methods from the mentioned acoustic environmental quantities, motion quantities and/or biometric data. For each survey time, the mean value or the mean crossing rate or the variance of individual values of a quantity since the preceding survey time can be formed and entered into the feature vector as the corresponding value of the environmental data.

For each survey time, values for at least four different features are determined, i.e., individual statistical manifestations of different environmental and/or motion and/or biometric quantities. Preferably, values are determined for at least six features. Especially preferably, the same statistical manifestations are determined for each individual quantity, such as the mean value, the mean crossing rate and the variance, as the values of the environmental data.

Now, in order to make it possible for a user to individually establish certain environmental situations with the aid of the "features" so determined, i.e., the corresponding feature vectors, the individual feature vectors containing the "features" at individual survey times are first mapped onto the particular corresponding representative vector in the representation space. The representation space here is at most three-dimensional, preferably two-dimensional, so that the representative vectors for a definition of the first environmental situation can be visualized in particular for the user by using the first region. Such a visualization of the representation space can be done in particular on a suitable visualization device of the hearing system, such as a monitor screen of a smartphone, which in this case becomes part of the hearing system by being incorporated in the method. A two-dimensional representation space can be represented here directly as a "map", a three-dimensional representation space by two-dimensional section planes or three-dimensional "point clouds" or the like, between which the user can switch or zoom or move.

The mapping of the feature vectors of the feature space onto the representative vectors of the representation space is done preferably such that "similar feature vectors", i.e., feature vectors lying relatively close to each other on account of a relative similarity of their features in the feature space, also lie relatively close to each other in the representation space (e.g., in relation to the entire size of the space used). Representative vectors (or groups of representative vectors) which are distinctly separated from each other in the representation space preferably imply feature vectors (or corresponding groups of feature vectors) separated from each other in the feature space, making possible a distinguishing of them. Conversely, a distinguishing of groups of feature vectors becomes more difficult with increasing overlap of the respective corresponding groups of their particular representative vectors in the representation space.

Now, with the aid of individual representative vectors lying as close as possible to each other, it is possible to define a first region in the representation space. This definition can be made in particular by the user of the hearing system, or also by a person assisting the user (such as a caregiver, a nurse, etc.). Preferably, a visualization of the representation space is used for the definition. In particular, individual representative vectors may be provided by means of an additional marking, such as a color representation, which may preferably correspond to an additional marking of the particular survey time according to the everyday/daily situation or the like for the particular feature vector by the user. This can simplify the matching up of the representative vectors for the user. The marking of the survey time can be done, for example, by a user input, establishing overall a particular situation in his daily routine, such as at home, in the car (on the way to work or on the way home), at the office, in the cafeteria, on the sports field, in the garden, etc.

Thus, a subgroup of representative vectors is now used to define the first region with the aid of their spatial distribution, in particular, with the aid of the area enclosed by them (i.e., their corresponding end points in the representation space). This subgroup of representative vectors corresponds to a group of feature vectors in the feature space, so that the first environmental situation is established in this way by the corresponding value ranges of the features.

For the first environmental situation so defined, which preferably stands in relation to a situation in the daily routine of the user, but may also be characterized by further features, especially acoustic features (e.g., different acoustic environments in the office or at home, etc.), the at least one value of the setting for the signal processing of the hearing system is now specified. This is done preferably by the user of the hearing system (or also by a technically versed assistant or care giver, for example). For this, the user preferably goes to the corresponding environment (e.g., a moving car, inside the house, outside in the garden, at the office/work site, etc.) and then modifies, especially "by ear", the signal processing settings, for example the treble or bass emphasis using a sound balance, or so-called adaptive parameters for wind or disturbing noise suppression. Basically, however, a fine tuning of each parameter may also be considered, which is typically done by a fully or semiprofessionally trained acoustician. It is likewise possible for the environment-specific signal processing setting, and thus the definition of the setting for the first environmental situation, to be done by such an acoustician during a remote customization session.

The training phase may thus be divided systematically into an analysis phase and a definition phase, the analysis phase involving the continuous measurement of the particular quantities, the determination of the individual corresponding feature values at the respective survey times, and a mapping of the feature vectors in the representation space, while in the definition phase the representative vectors are used to define the first environmental situation and the corresponding at least one value of the setting for the signal processing.

During an application phase, the definitions made for the first environmental situation and the corresponding at least one setting for the signal processing of the hearing system are incorporated into the operation of the hearing system. For this, at an application time of the application phase, first of all the same environmental and/or motion and/or biometric quantities are measured by the hearing system, especially also by a hearing device of the hearing system, as are also measured in the training phase for determining the values of environmental data. In an analogous manner, from the measured quantities the values for the same kinds of environmental data and a corresponding feature vector are formed, as in the training phase.

The feature vector for the application time is now mapped into the representation space. This is done preferably by means of the same algorithm as the corresponding mappings of the training phase, or by an approximation method as consistent as possible with the algorithm, which in particular maps the feature vector of the application time onto a representative vector in the representation space, for which representative vectors of its immediate environment are based on such feature vectors of the training phase that also form the immediate environment of the feature vector of the application time in the feature space.

Now, if the representative vector so formed for the application time lies in the first region of the representation space, it may be inferred that the first environmental situation is present, and accordingly the at least one setting of the signal processing previously defined for this can be used in the operation of the hearing system, i.e., a corresponding, possibly frequency band-dependent amplification and/or dynamic compression, voice signal emphasis, etc., can be applied to an audio signal of the hearing system.

Alternatively, for this, those areas can be identified in the feature space which correspond to the feature vectors whose representative vectors in the representation space are encompassed by the first region. The identification of the first environmental situation can then also be done with the aid of the areas in the feature space if the feature vector for the application time lies in such an area.

In particular, a brief temporal communication (such as in the range of a few seconds to a few minutes) or some other statistical processing can be done to form the feature vector of the application time, preferably of the same kind as in the forming of the feature vectors of the training phase.

The method described makes it possible to customize the definitions of individual environmental situations specifically to individuals or special groups of hearing aid wearers, and moreover to have this definition done as well by (technically versed) persons without audiological or scientific training, requiring only a relatively slight effort of the hearing system (or of an assisting companion) for the definitions of the environmental situations, since this can be done directly through the visualization of the preferably two-dimensional representation space.

In this way, the needs of small user groups can be addressed in particular, for which too large an effort would be required on the part of a manufacturer (or some other solution provider) for a specific definition of environmental situations for the automatic setting of the hearing system. In this way, hearing systems can provide classifiers for the environment which more specifically meet the needs of such user groups than the "stereotypical" classes of environmental situations known thus far, since universalized classes such as "in the car" and "watching television" have been defined precisely because the overwhelming majority of users of hearing systems find themselves in such a situation.

Since the method furthermore is also suited to being used by technically versed persons, without audiological or scientific training, the prospect is opened up for not only the manufacturer of a hearing system (such as a hearing aid manufacturer), but also other market players or users to undertake their own definitions, such as hearing aid acousticians or the like, companions of persons in special occupational groups (such as dentists, musicians, hunters), or even individual technically versed users. Hence, the method is relevant for use by a large number of users, since there are relatively few users of hearing systems who are willing to provide comprehensive information (input, for example, in smartphone apps), but on the other hand there are many users who would like to provide as little information as possible beyond the selection of a particular function, and who only provide an input when the hearing process appears unpleasant to them, or in need of improvement.

In particular, it is also possible for the definition of the first environmental situation to be done by a first user of the hearing system in the training phase, while this definition is used by a second user in the application phase. Hence, a first user can provide the environmental situations defined by him for corresponding feature vectors to other users for their use. The definition of the setting of the signal processing belonging to the first environmental situation is preferably carried out by the user who is using the hearing system in the application phase.

Preferably, in the training phase a user input is used to save information on a current usage situation of the hearing system, especially in dependence on a defined situation of a daily routine of the first user of the hearing system, wherein the respective information on the usage situation is combined with the feature vectors and/or the corresponding representative vectors which are formed with the aid of the values of the environmental data collected during a particular user situation. The usage situation here preferably describes a given situation in the daily routine of the user, i.e., for example, at home, in the car (on the way to work/on the way home), at the office, in the cafeteria, on the sports field, in the garden, etc. By an additional marking of the feature vector or the corresponding representative vectors, the user can also match up the first environmental situation with regard to the usage situation.

Advantageously, at least one partial area of the representation space is visualized, especially by means of a monitor screen, and at least one subset of the representative vectors is displayed. The first region in the representation space is defined with the aid of a user input, especially in regard to a grouping of visualized representative vectors. The monitor screen in this case is integrated in particular in a corresponding auxiliary device of the hearing system, such as a smartphone, tablet, or the like, especially one which can be connected wirelessly to the hearing device. The user can then view the individual representative vectors directly on the touchscreen in a two or possibly also a three-dimensional representation (in the 3D case, through corresponding cross section planes) and group them accordingly for the first region.

The respective information about the usage situation is visualized in particular for at least a few of the representative vectors, at least because of an action of the first user. This can be done by an appropriate color representation or by inserting a label on the particular representative vector.

Preferably, at least in the training phase the mapping of the feature vectors onto the corresponding representative vectors is done in such a way that distance relations of at least three feature vectors in the feature space remain at least approximately preserved as a result of the mapping for distance relations of the corresponding three representative vectors in the representation space. This means, in particular, that for three respective feature vectors mv1, mv2, mv3 with the following distance relation in the feature space:

$$|mv1-mv2|>|mv1-mv3|>|mv2-mv3|, \quad \text{a)}$$

the corresponding representative vectors rv1 (for mv1), rv2 (for mv2), rv3 (for mv3) in the representation space fulfill the distance relation $$|rv1-rv2|>|rv1-rv3|>|rv2-rv3|. \quad \text{b)}$$

In this way, groups of "similar" feature vectors, differing only slightly from each other in regard to the entire region covered in the feature space, are mapped onto "similar" representative vectors, which likewise differ only slightly from each other in regard to the entire area covered in the representation space.

Preferably, the mapping of the feature vectors onto the respective associated representative vectors is done with the aid of a principal component analysis (PCA) and/or a locally linear embedding (LLE) and/or an isomapping and/or a Sammon mapping and/or preferably with the aid of a t-SNE algorithm and/or preferably with the aid of a self-organizing Kohonen network and/or preferably with the aid of a UMAP mapping. The mentioned methods fulfill the mentioned property in regard to the distance relations and they are efficiently implementable.

Advantageously, in the application phase, values for the first plurality of environmental data are determined for a plurality of successive application times and the values of the environmental data are used to form corresponding feature vectors for the successive application times. Wherein a presence of the first environmental situation is identified with the aid of the first region and with the aid of the feature vectors for the successive application times, especially with the aid of a polygon course of the feature vectors or a polygon course of the representative vectors corresponding to the feature vectors in the representation space. In particular, areas for feature or representative vectors outside of the particular polygon course can be identified in this case by means of machine learning, in which a corresponding feature or representative vector for an application time results in a presence of the first environmental situation.

For example, always the most recent five representative vectors (of the past application times) are used to construct a polygon course, encompassing all the representative vectors (some or all of the representative vectors or their end points then constitute corner points of the polygon course). Only then is the hearing system matched up with the first environmental situation and the corresponding setting of the signal processing is activated if at least a previously definable percentage of the area of the polygon course (such as 80%) lies within the first region in the representation space. In this way, it can be avoided that a single "outlier" of an individual feature, attributable to a random, yet possibly atypical occurrence for an environment, will result in an altered classification in regard to the environmental situation.

Advantageously, acoustical environmental data are determined for the first plurality of environmental data with the aid of a signal of at least one electroacoustical input transducer, especially a microphone, and/or motion-related environmental data are determined with the aid of at least one signal of an acceleration sensor, especially on with multidimensional resolution, and/or a gyroscope, and/or a GPS sensor. Preferably, moreover, location-related environmental data are determined for the first plurality of environmental data with the aid of at least one signal of a GPS sensor and/or a WLAN connection and/or biometric environmental data are determined with the aid of an ECG sensor and/or an EEG sensor and/or a PPG sensor and/or an EMG sensor. In particular, a sensor for generating biometric environmental data can be arranged on an auxiliary device designed as a smartwatch. The mentioned sensors are especially suitable for a most comprehensive characterization of an environmental situation of a hearing system.

Preferably, for the acoustic environmental data, there is analyzed the signal of the at least one electroacoustic input transducer in regard to a speech activity of the first or second user of the hearing system and/or in regard to an occurrence of wind at the electroacoustic input transducer and/or in regard to a spectral centroid of a noise background and/or in regard to a noise background in at least one frequency band and/or in regard to a stationarity of a sound signal of the environment and/or in regard to an autocorrelation function and/or in regard to a modulation depth for a given modulation frequency, which is preferably 4 Hz and at most 10 Hz, and/or in regard to the commencement of a speech activity, especially the user's own speech activity.

Preferably, there are determined each time as the values of the environmental data for a survey time and/or the application time a mean value and/or a variance and/or a mean crossing rate and/or a range of values and/or a median of the respective environmental data, especially in relation to a period of time between the respective survey time and an immediately preceding survey time or in relation to a period of time between the application time and an immediately preceding application time. By means of these data, an environmental situation of a hearing system can be characterized especially comprehensively.

Preferably, a recording of a sonic signal of the environment is made during a survey time by means of the at least one electroacoustic input transducer, and this is matched up with the feature vector as well as the corresponding representative vector for the survey time; wherein, upon a user input, the recording is played back through at least one output transducer of the hearing system, especially through a loudspeaker. Thus, the user can additionally identify which specific acoustic event—i.e., which noise—is the basis of a representative vector, and use this for the definition of the first region.

Advantageously, the acoustic environmental data are used to form respectively individual vector projections of the feature vectors of the survey times in an acoustic feature space. The vector projections of the acoustic feature space are respectively mapped onto acoustic representative vectors in a maximum three-dimensional, especially a two-dimensional acoustic representation space. A second region is defined in the acoustic representation space for the first environmental situation of the hearing system, and a presence of the first environmental situation is identified, in addition, with the aid of the second region of the acoustic representation space, especially by a comparison with a mapping of the feature vector of the application time in the acoustic representation space.

It may be that the user of the hearing system finds himself in an environment where certain short noises are disturbing to him, so that he prefers signal processing settings for this environment that muffle these noises. A typical example is the striking of a spoon against a coffee cup, or the shrill clatter of dishes. There are various possibilities for this, for example reducing the amplification of high frequencies somewhat, increasing the dynamic compression in the high frequency range, or activating a signal processing that specifically moderates suddenly occurring sound peaks.

If, now, the user for example once marks a representative vector based on the suddenly occurring sound peaks of the spoon striking against the coffee cup, the user can then find the marking of the corresponding representative vector in a visualized representation. This vector will be expected to be found in that area of the representation space in which the representative vectors of an "at home" usage situation lie, but not in usage situations such as "office" or "in the car". The user could now establish one of the mentioned changes for the "at home" usage situation, such as an increased dynamic compression in the high frequency range. Before doing so, it is advisable to check whether there are other similar noises which might likewise sound different as a result of the altered signal processing settings.

The user may profit from a representation of the corresponding acoustic representative vectors constituting a projection of the corresponding acoustic feature vector of the acoustic features in the acoustic representation space in order to produce the first environmental situation in addition or also solely with the aid of the representation of the purely acoustic environment in the acoustic representation space of the corresponding second area.

For this, the representation space with appropriate emphasizing of the relevant representative vector for the sound event and the acoustic representation space with the corresponding acoustic representative vector can be visualized at the same time, e.g., alongside each other.

This representation offers the advantage to the user that sound events (i.e., noises) can be identified in the representation of the acoustic representative vectors which are very similar to the marked feature ("door bell")—likewise due to a relative proximity of the corresponding acoustic representative vectors. The "complete" representative vectors (which are additionally based on non-acoustic data) of the two sound events ("spoon striking coffee cup" and "door bell") are presumably to be found in the same region of the representation space and are matched up in particular with the same usage situation ("at home").

If, now, the user performs a setting of the signal processing for the first second area of the representation space or the acoustic representation space and thus for the so defined first environmental situation, whereby spontaneously occurring clear sounding tones ("coffee cup") are muffled, for example, he can then identify that similar noises ("door bell" or also "smoke alarm") are likewise muffled on account of the acoustic representation space, so that he may decide not to perform a complete muffling in order no to miss such noises.

It is further proven to be advantageous when the first environmental situation is defined in addition with the aid of a first usage situation, and for the first environmental situation a first value of the setting for the signal processing of the hearing system is specified. A second environmental situation is defined with the aid of a second usage situation, and a corresponding second value of the setting is specified, wherein in particular the second region, corresponding in the acoustic representation space to the first environmental situation, overlaps at least partly with the second region, corresponding in the acoustic representation space to the second environmental situation. A presence of the first or the second environmental situation is identified with the aid of a presence of the first or second usage situation, and thereupon the first or second value of the signal processing of the hearing system is set, corresponding to its specification for the first or second environmental situation.

This means in particular that the user is put in the position to identify similar noises, which arise in different environments and especially different usage situations. Depending on the usage situation, the user of the hearing system may prefer different signal processing settings for certain similar noises.

As an example, one can mention here a hunter who might perceive the rustling of a newspaper as unpleasant, yet would like to hear any rustling of fallen leaves when on the hunt. In the training phase, the rustling of a newspaper is marked as unpleasant, but the rustling of fallen leaves is not marked. As long as the noises are acoustically very similar, yet otherwise distinguishable, the user can define different environmental situations and thus different settings of the signal processing. The desire for different handling of different "rustling" may occur, e.g., in the different usage situations "at home" (e.g., reading a newspaper) or "work/office" (colleague paging through documents) vs. "outdoors" (relaxing in the woods).

The possibility of different handling is then provided in particular by determining feature vectors in the training phase from all sensors of the hearing aid, i.e., using the recorded audio signals (microphones) and also other sensor signals, that are mapped in the representation space; from the recorded audio signals, acoustic feature vectors are determined that are mapped in the acoustic representation space.

By using a marked acoustic representative vector, the user can recognize that he wishes to have an altered signal processing (e.g., "newspaper rustling" is marked), but he receives information through the acoustic representation space that there are also very similar noises (here: rustling in fallen leaves). The marked acoustic representative vector for the noise "newspaper rustling" may form in particular a first subgroup of the acoustic representative vector and thus a first area in the acoustic representation space, and another acoustic representative vector for the noise "rustling in fallen leaves" forms the second area.

The user may now select such a similar noise in the visualization and thereupon have displayed in the ("complete") representation space the marked representative vector as well as the acoustically similar representative vector and notice from their positions whether they lie in different regions there. The one region then represents the situation "at home", the other for example "in the woods". If this distinguishability beyond acoustic similarity exists, then the signal processing is specifically customized for the one environmental situation ("at home"), but not for the other environmental situation ("in the woods").

Advantageously, a hearing system is used, containing a hearing device, especially a hearing aid and/or a hearing assist device and/or a headphone, as well as a computing unit, and having especially a visualization device.

Preferably, the definition of the first region for the first environmental situation is done in the training phase by the first user of a hearing system and is saved in a cloud serve. Wherein for the application phase the definition is downloaded by the second user of a hearing system comparable for the application, especially an identical hearing system in regard to the hearing device, from the cloud server to the hearing system. In this way, individual environmental situations pertaining to users can be used for other users.

Preferably, in the application phase, a correction is made for the definition of the first region and/or for the specification of the at least one value of a setting of the signal processing of the hearing system by a user input, and then the corrected first region or the corrected value of the signal processing setting is used in the application phase. In this way, on the one hand, the user can later adapt the definition of the at least one signal processing setting made previously for a first environmental situation, and on the other hand also afterwards match up a noise, for example, with an environmental situation, or also later on erase such a match-up.

Advantageously, each of the feature vectors is mapped onto a corresponding representative vector in a one-dimensional representation space, defining a first interval in the representation space as the first region for the first environmental situation of the hearing system with the aid of a spatial distribution of the end points of a subgroup of representative vectors. A one-dimensional representation space may be especially advantageous for a comparable small number of features (e.g., a six-dimensional feature space).

The invention furthermore designates a hearing system, containing a hearing device, especially a hearing aid, hearing assist device or a headphone, and an auxiliary device with a computing unit, especially a processor unit of a smartphone or tablet, wherein the hearing system is designed to perform the above-described method. The hearing system according to the invention shares the benefits of the method according to the invention. The benefits indicated for the method according to the invention and its modifications can be applied accordingly to the hearing system.

Preferably the hearing system contains a visualization device and/or an input device for a user input. In particular, the visualization device and the input device are implemented by a touchscreen of a smartphone or tablet, which can be connected to the hearing device for data transmission.

In a preferred embodiment the hearing system contains the following parts:

a) a hearing device, preferably given by a hearing aid, especially one adapted to record an audio signal by means of at least one built-in microphone, as well as having preferably one or more sensors, such as an acceleration sensor and/or gyroscope, which record "non-acoustic" environmental data. The hearing device is preferably adapted to create the feature vector from the environmental data and in particular to create an acoustic feature vector from the acoustic environmental data.

b) An auxiliary device, containing the visualization device and the input device, and preferably formed by a smartphone or a tablet. In particular, the auxiliary device contains further sensors for determination of environmental data (such as location data based on GPS), wherein the auxiliary device is preferably adapted by means of a wireless connection to transmit this environmental data to the hearing device or to receive the environmental data of the hearing aid and to create the mentioned feature vectors.

Furthermore, individual modular functions or components are preferably implemented in the hearing system, making it possible to carry out the above described method. These modular functions comprise, in particular:

a) a software input module, providing a user interface, on which the user can establish specific environmental situations, but also usage situations, and provide them with appropriate marking ("at home", "in the car", "in the office", "in the cafeteria", "television", "bicycle riding", "in the music room"), indicate whether he is now in one of the established usage situations or is leaving such situation, establish specific events and provide them with a marking ("dentist drill", "vacuum cleaner", "newspaper rustling", "playing musical instrument"), as well as indicate when an established event actually occurs;

b) a dimension reduction module, which maps the feature vectors collected in the training phase in the 2-dimensional (or 3-dimensional or also one-dimensional) representation space. The dimension reduction module may be implemented in particular in different variants, namely, through an implementation of the t-SNE optimization method, as UMAP, PCA, or Kohonen network, which receives the high-dimensional feature vectors at the input side and puts out 2-dimensional (or 3-dimensional) representative vectors. The dimension reduction module can be implemented on the hearing device, on a smartphone as an auxiliary device, or on an additional computer such as a PC/laptop. When the optimization method t-SNE is used, it is advantageous to implement the dimension reduction module preferably on the smartphone as an auxiliary device or on a PC/laptop, since powerful processors are available there for the computations. The Kohonen network may be implemented either as specialized hardware on an ASIC of the hearing device, or on a neuromorphic chip of the hearing device, which is configured as a Kohonen network, yet can also be configured for other tasks. The Kohonen network may also be implemented on the auxiliary device;

c) a feature editor for representation of vectors of an especially 2-dimensional space as points or also arrows in a surface on a display or monitor screen, for highlighting of points according to a marking of the represented vector, e.g., by a corresponding coloration, for text presentation of properties of individual points, such as corresponding text fields directly next to a point, and for representing two especially 2-dimensional spaces alongside each other (a representation space and an acoustic representation space of the corresponding representative vectors).

A coloration of points may correspond to markings with which individual feature vectors were provided. When the markings indicate a usage situation or an environmental situation, the coloration will reflect this accordingly.

Once the user selects a point (representative vector) of the acoustic representation space, the corresponding point of the "complete" representation space can be optically highlighted. Thus, the user can notice whether two acoustic events similar to each other, such as newspaper rustling and rustling in fallen leaves, lying close to each other in the acoustic feature space, can be matched up with mutually distinguishable environment situations by the dimension reduction, taking other environment features into account, such as "at home" or "in the woods", because the corresponding representative vectors of the representation space then lie in different regions. The feature editor can be implemented in particular on the auxiliary device.

a mapping module, which maps feature vectors in the 2- or 3-dimensional representation space in the application phase. The mapping module is preferably implemented in the hearing device itself, but it may also be implemented on the auxiliary device (preferably provided as a smartphone), and the result of that mapping is sent to the hearing device. When the dimension reduction module uses a t-SNE method, a feature vector is mapped with an approximation function into the representation space; when the dimension reduction works by means of a Kohonen network, the mapping can be done by the same Kohonen network.

Other features which are considered as characteristic for the invention are set forth in the appended claims.

Although the invention is illustrated and described herein as embodied in a method for the environment-dependent operation of a hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a block diagram showing a method for an environment-dependent operation of a hearing system

DETAILED DESCRIPTION OF THE INVENTION

Referring now to the sole FIGURE of the drawing, there is shown schematically in a block diagram a method for the environment-dependent operation of a hearing system 1, where the hearing system in the present instance is formed by a hearing device 3, configured as a hearing aid 2, as well as an auxiliary device 5, configured as a smartphone 4. The hearing device 3 contains at least one electro-acoustic input transducer 6, which in the present instance is configured as a microphone and which produces an audio signal 7 from an environmental sound. Furthermore, the hearing device 3 contains other sensors 8, generating additional sensor signals 9. The sensors 8 may comprise, e.g., an acceleration sensor or also a temperature sensor.

In a training phase 10 of the method, the audio signal 7 and the sensor signal 9 are used to determine environmental data each time for a plurality of survey times T1, T2, T3. This is done in the present case by first generating the acoustic environmental data 12 in ongoing manner from the audio signal 7. The acoustic environmental data 12 contains here: a 4 Hz modulation; an onset mean; an autocorrelation function; a level for low and medium frequencies of a noise background, as well as a centroid of the noise background; a stationarity; a wind activity; a broadband maximum level; one's own voice activity. Likewise, motion-related environmental data 14 is generated in ongoing manner from the sensor signal 9, which contains the measured instantaneous accelerations in the three directions of space.

Further kinds of acoustic environmental data 12 and/or motion-related environmental data 14 or other, especially location-related and/or biometric environmental data can generally be included as environmental data 15, such as magnetic field sensors, other cell phone and/or smartwatch sensors, a gyroscope, a pulse metering, a PPG measurement (photoplethysmogram), an electrocardiogram (ECG), a detection of stress through the measurement of the heart rate and its variation, a photosensor, a barometer, a listening effort or a listening activity (such as one through "auditory attention" by means of an EEG measurement), a measurement of eye or head motions through muscle activity (EMG), location information via GPS, WLAN information, geo-fencing or Bluetooth beacons for the current location or area.

For the acoustic environmental data 12 (in the present case, ten different kinds of data) and the three (in the present case) motion-related environmental data 14, each time a buffering 16 is performed for the period between two survey times T1, T2, T3 (the mentioned signals are buffered from a start time T0 for a recording at the survey time T1). Then, for each individual kind of the acoustic environmental data 12 and the motion-related environmental data 14 there is formed a mean value Mn, a variance Var and a mean crossing rate MCR. The mentioned statistical quantities Mn, Var, MCR of the individual acoustic environmental data 12 and the motion-related environmental data 14 during the buffered time between two survey times T1, T2, T3 form respective environmental features 16 for the survey time T1, T2, T3 at the end of the buffering period, and are mapped each time onto a high-dimensional feature vector M1, M2, M3 in a high-dimensional feature space 18. The high dimensionality, such as 39D for respectively three statistical features from ten acoustic and three motion-related environmental data points, is only indicated here by the number of axes on the diagrams of the feature space 18 for the individual feature vectors M1, M2, M3.

Each of the feature vectors M1, M2, M3 is now mapped from the feature space 18 onto a corresponding representative vector R1, R2, R3 in a two-dimensional representation space 20. The mapping is done here for example by means of a t-SNE optimization method (t-distributed stochastic neighbor embedding).

In the following, the optimization method will be briefly described (see, e.g., "Visualizing Data using t-SNE", 2008, Laurens van der Maaten and Geoffrey Hinton).

A so-called perplexity parameter defines a number of effective neighbors of the feature vectors, i.e., the perplexity parameter determines how many neighbors have influence on the final position of the corresponding representative vector in the two-dimensional representation space 20 (this parameter in the present instance can be set, e.g., at a value of 50 or on the order of 1/100 of the number of feature vectors). Thereafter, for all pairs of high-dimensional feature vectors the degrees of probability are calculated one time, that two particular feature vectors are to be identified as closest neighbors in the high-dimensional feature space. This mirrors a starting situation.

For the two-dimensional representation space, randomly Gauß-distributed random values Y are assumed as the start value. Thereafter, the current similarity relations in Y are calculated in individual iterations. For the optimization of the mapping of the similarity relations, a similarity is now determined between the feature space and the representation space with the aid of a Kullback-Leibler divergence. Using the gradient of the divergence, the representative vectors (or their end points) are shifted along in the representation space for T iterations.

One possible representation of the algorithm is:

feature space of the high-dimensional feature vectors $X=\{x_1; x_2; \ldots; x_n\}$ with n being the number of all feature vectors present (in the present case, e.g., n=4016);

cost function parameter: "perplexity" Perp: determines the number of effective neighbors, by choice of the variance $\sigma_i$ for each point by a binary search (strong influence on Y);

optimization parameter: determination of a number of iterations t of T (e.g., 500), a learning rate h (e.g., 1000), and a momentum a(t) (e.g., 0.5 for t<250, otherwise a(t)=0.8); and result: two-dimensional representation space $Y=\{y_1; y_2; \ldots; y_n\}$ start of method:

calculate the degree of probability for all feature vector pairs $\mu_{ij}$ in the high-dimensional space:

$$p_{j|i} = \frac{\bar{p}_{j|i}}{\sum_{k\neq i}\bar{p}_{k|i}} \text{ with } \bar{p}_{j|i} = \exp(-\|x_i - x_j\|^2/2\sigma_i)$$

$$\text{set } p_{ij} = \frac{p_{j|i} + p_{i|j}}{2n}$$

"random drawing" of n two-dimensional Gauß-distributed random numbers for the initialization of Y;

optimizing of the r mapping in the representation space:

counting loop of the optimization for t=1 to T:

Calculate the current degree of probability in the two-dimensional space:

$$q_{ij} = \frac{(1 + \|y_i - y_j\|^2)^{-1}}{\sum_{k\neq l}(1 + \|y_k - y_l\|^2)^{-1}}$$

measure the similarity between X and Y (Kullback-Leibler divergence)

$$C = \sum_j \sum_i p_{ij} \log\left(\frac{p_{ij}}{q_{ij}}\right)$$

calculate the gradient:

$$\frac{\partial c}{\partial y_i} = 4\sum_j (p_{ij} - q_{ij})(y_i - y_j)(1 + \|y_i - y_j\|^2)^{-1}$$

shift the two-dimensional representative vectors:

$$y_i^{(t)} = y_i^{(t-1)} + h\frac{\partial c}{\partial y_i} + a(y_i^{(t-1)} - y_i^{(t-2)})$$

end of optimization end of method

In terms of the present method, the representative vectors R1, R2, R3 in the two-dimensional representation space 20 are thus generated by the above described mapping procedure from the feature vectors M1, M2, M3 of the feature space 18.

A user of the hearing system 1 can now have the representation space 20 displayed on his auxiliary device 5 (on the monitor screen 21 of the smartphone 4), and define a cohesive area 22 as a first region 24 corresponding to a specific first environmental situation 25 in his use of the hearing system 1. The user can now match up the first region 24 with a specific setting 26 of a signal processing of the audio signal 7 in the hearing device 3, for example, frequency band-related amplification and/or compression values and parameters, or control parameters of a noise suppression and the like. With the matching up of the setting 26 of the signal processing and the first region 24 (and thus the present first environmental situation 25, as characterized by the values of the environmental data 15 in the individual feature vectors M1, M2, M3), the training phase 10 for a particular environmental situation may be considered as being finished. Preferably, multiple training phases 10 will be done for different environmental situations.

In an application phase 30, now, the same environmental data 15 is gathered as in the training phase from the audio signal 7 of the hearing device 3 and from the sensor signal 9 for an application time T4, and a feature vector M4 in the high-dimensional feature space 18 is formed from it in corresponding manner, using the values determined for the application time T4 in the same way. The values here may be formed for example from the mean value Mn, the variance Var and the mean crossing rate MCR of the acoustic and motion-related data 12, 14 gathered during a short time (such as 60 seconds or the like) prior to the application time T4.

The feature vector M4 for the application time T4 is now mapped onto a representative vector R4 in the representation space 20.

Since the t-SNE method used in the training phase 10 of the present example for the mapping of the feature vectors M1, M2, M3 of the feature space 18 onto the representative vectors R1, R2, R3 in the representation space 20 is an optimization method requiring knowledge of all feature vectors used, a corresponding mapping in the application phase 30 is done by means of an approximation mapping (e.g., a so-called "out-of-sample extension", 00S kernel). This may be done by a regression, by means of which a mapping with the aid of a plurality of feature vectors of the feature space 18 (such as 80% of the feature vectors) onto corresponding representative vectors of the representation space 20 is "learned", and remaining feature vectors (i.e., in this case, 20%) are used to "test" the quality of the resulting mapping. With the mapping of the "learning vectors", i.e., the feature vectors used to learn the mapping, onto corresponding representative vectors, a kernel function can then be determined, which preserves local distance relations between said feature and representative vectors in their respective spaces (feature and representation space). In this way, a new, unknown feature vector can be mapped from the feature space 18 onto a corresponding representative vector in the representation space 20, by preserving the local distance relations between the known "learning vectors".

A more detailed explanation will be found, e.g., in "Out-of-Sample Kernel and Extensions for Nonparametric Dimensionality Reduction", Andrej Gisbrecht, Wouter Lueks, Bassam Mokbel and Barbara Hammer, ESANN 2012 proceedings, European Symposium on Artificial Neural Networks, Computational Intelligence and Machine Learning, Bruges (Belgium), 25-27 Apr. 2012, as well as "Parametric nonlinear dimensionality reduction using kernel t-SNE", Andrej Gisbrecht, Alexander Schulz and Barbara Hammer, Neurocomputing, Vol. 147, 71-82, January 2015.

Now, if the representative vector R4 determined as described for the application time T4 lies in the first region 24, it will be recognized that the first environmental situation 25 is present for the hearing system 1, and, accordingly, the hearing device 3 will be operated with the settings 26 for the signal processing of the audio signal 26, and the previously defined amplification and/or compression values and parameters, or control parameters of a noise suppression, will be applied to the audio signal 7.

Although the invention has been described and illustrated in detail by the preferred exemplary embodiment, the invention is not limited by this exemplary embodiment. Other variations may be deduced from it by the person skilled in the art, without leaving the scope of protection of the invention.

The following is a summary list of reference numerals and the corresponding structure used in the above description of the invention:

1 Hearing system
2 Hearing aid
3 Hearing device
4 Smartphone
5 Auxiliary device
6 Input transducer
7 Audio signal
8 Sensor
9 Sensor signal
10 Training phase
12 Acoustic environmental data
14 Motion-related environmental data
16 Buffering
18 Feature space
20 Representation space
21 Monitor screen
22 Area
24 First region
25 First environmental situation
26 Setting (of a signal processing)
30 Application phase
M1, M2, M3 Feature vector (in the training phase)
M4 Feature vector (in the application phase)
MCR Mean crossing rate
Mn Mean value
R1, R2, R3 Representative vector (in the training phase)
R4 Representative vector (in the application phase)
T0 Start time
T1, T2, T3 Survey time
T4 Application time
Var Variance

The invention claimed is:

1. A method for an environment-dependent operation of a hearing system (1), which comprises the steps of:

performing a training phase, which comprises the substeps of:

determining values for a first plurality of environmental data of a first user of the hearing system each time for a plurality of survey times;

using the values of the environmental data for each of the survey times to form respectively a feature vector in an at least four-dimensional feature space;

mapping each of the feature vectors respectively onto a corresponding representative vector in a maximum three-dimensional representation space;

using a spatial distribution of a subgroup of representative vectors to define a first region in the maximum three-dimensional representation space for a first environmental situation of the hearing system;

specifying at least one value of a setting for a signal processing of the hearing system for the first environmental situation;

performing an application phase, which comprises the substeps of:

determining at an application time values for the first plurality of environmental data of the first user or of a second user of the hearing system in the application phase;

using the values of the environmental data to form a corresponding feature vector for the application time;

using the first region of the maximum three-dimensional representation space and the feature vector for the application time to identify a presence of the first environmental situation, and the at least one value of the signal processing of the hearing system is set according to its specification for the first environmental situation; and operating the hearing system with the at least one value set in this way.

2. The method according to claim 1, wherein:

in the training phase using a user input to save information on a current usage situation of the hearing system; and the information on the current usage situation is combined with the feature vectors and/or corresponding representative vectors which are formed with an aid of the values of the environmental data collected during a particular user situation.

3. The method according to claim 2, which further comprises:

determining acoustical environmental data for the first plurality of environmental data with an aid of a signal of at least one electroacoustical input transducer and/or determining motion-related environmental data with an aid of at least one signal of an acceleration sensor and/or a gyroscope, and/or determining location-related environmental data with an aid of at least one signal of a global positioning system (GPS) sensor and/or a wireless local area network connection, and/or determining biometric environmental data with an aid of an electrocardiogram (ECG) sensor and/or an electroencephalograghy (EEG) sensor and/or a photoplethysmogram (PPG) sensor and/or an electromyography (EMG) sensor.

4. The method according to claim 3, wherein for the acoustic environmental data there is analyzed the signal of the at least one electroacoustic input transducer:

in regard to speech activity of the first or second user of the hearing system; and/or in regard to an occurrence of wind at the electroacoustic input transducer; and/or in regard to a spectral centroid of a noise background; and/or in regard to a noise background in at least one frequency band; and/or in regard to a stationarity of a sound signal of the environment; and/or in regard to an autocorrelation function; and/or in regard to a modulation depth for a given modulation frequency, which is at most 10 Hz; and/or in regard to the commencement of the speech activity.

5. The method according to claim 3, wherein there are determined each time as the values of the environmental data for a survey time of the survey times and/or the application time a mean value and/or a variance and/or a mean crossing rate and/or a range of values and/or a median of the environmental data.

6. The method according to claim 3, wherein:

the acoustic environmental data are used to form respectively individual vector projections of the feature vectors of the survey times in an acoustic feature space;

the individual vector projections of the acoustic feature space are respectively mapped onto acoustic representative vectors in a maximum three-dimensional acoustic representative space;

a second region is defined in the maximum three-dimensional acoustic representation space for the first environmental situation of the hearing system; and a presence of the first environmental situation is identified, in addition, with the aid of the second region of the maximum three-dimensional acoustic representation space.

7. The method according to claim 3, wherein:

the first environmental situation is defined in addition with an aid of a first usage situation, and for the first environmental situation a first value of the setting for the signal processing of the hearing system is specified;

a second environmental situation is defined with an aid of a second usage situation, and a corresponding second value of the setting is specified; and a presence of the first or the second environmental situation is identified with an aid of a presence of the first or second usage situation, and thereupon the first or second value of the signal processing of the hearing system is set, corresponding to its specification for the first or second environmental situation.

8. The method according to claim 3, wherein there are determined each time as the values of the environmental data for a survey time of the survey times and/or the application time a mean value and/or a variance and/or a mean crossing rate and/or a range of values and/or a median of the environmental data, namely in relation to a period of time between a respective survey time and an immediately preceding survey time or in relation to a period of time between the application time and an immediately preceding application time.

9. The method according to claim 2, wherein the step of using the user input to save the information on the current usage situation of the hearing system is performed in dependence on a defined situation of a daily routine of the first user of the hearing system.

10. The method according to claim 1, wherein:

at least one partial area of the maximum three-dimensional representation space is visualized;

at least one subset of corresponding representative vectors is displayed; and the first region in the maximum three-dimensional representation space is defined with an aid of a user input.

11. The method according to claim 10, wherein:

the at least one partial area of the maximum three-dimensional representation space is visualized by means of a monitor screen; and the first region in the maximum three-dimensional representation space is defined with the aid of the user input in regard to a grouping of visualized representative vectors.

12. The method according to claim 1, wherein at least in the training phase the mapping of feature vectors onto corresponding representative vectors is done in such a way that distance relations of at least three the feature vectors in the at least four-dimensional feature space remain at least approximately preserved as a result of the mapping for distance relations of the three corresponding representative vectors in the maximum three-dimensional representation space.

13. The method according to claim 1, wherein in the application phase a presence of the first environmental situation is identified by mapping the feature vector for the application time in the maximum three-dimensional representation space, and a position of a resulting formed representative vector relative to the first region is evaluated.

14. The method according to claim 13, wherein the representative vector is identified as lying within the first region.

15. The method according to claim 1, wherein in the application phase a presence of the first environmental situation is identified with an aid of the feature vector for the application time and with an aid of at least some feature vectors in the at least four dimensional feature space that are mapped in the maximum three-dimensional representation space onto the representative vectors of the first region.

16. The method according to claim 1, wherein:

in the application phase the values for the first plurality of environmental data in each case are determined for a plurality of successive application times and the values of the environmental data are used to form corresponding feature vectors for the successive application times; and the presence of the first environmental situation is identified with an aid of the first region and with an aid of the corresponding feature vectors for the successive application times.

17. The method according to claim 16, wherein a presence of the first environmental situation is identified with the aid of the first region, with the aid of the corresponding feature vectors for the successive application times, an aid of a polygon course of the feature vectors or a polygon course of representative vectors corresponding to the feature vectors in the maximum three-dimensional representation space.

18. The method according to claim 1, wherein:

a definition of the first region for the first environmental situation is done in the training phase by the first user of the hearing system with a hearing device and is saved in a cloud server; and for the application phase the definition is downloaded by the second user of the hearing system comparable for the application from the cloud server to the hearing system.

19. The method according to claim 1, wherein:

the at least four-dimensional feature space is an at least six-dimensional feature space;

the maximum three-dimensional representation space is a two-dimensional representation space; and the at least one value of the signal processing of the hearing system is set according to its specification for the first environmental situation in an automatic manner.

20. A hearing system, comprising:

a device selected from the group consisting of a hearing device, a hearing aid, a hearing assist device and a headphone;

an auxiliary device with a processor; and the hearing system is adapted to perform a method according to claim 1.

* * * * *